United States Patent [19]

Tsuda

[11] 4,053,304

[45] Oct. 11, 1977

[54] FLUX FOR REFINEMENT OF PRO-EUTECTIC SILICON CRYSTAL GRAINS IN HIGH-SILICON ALUMINUM ALLOYS

[76] Inventor: Masatoshi Tsuda, 6 Minamiichijocho, Taishogun, Kita, Kyoto, Japan

[21] Appl. No.: 721,970

[22] Filed: Sept. 10, 1976

[30] Foreign Application Priority Data

June 18, 1976 Japan ..... 51-70979

[51] Int. Cl.[2] ..... C22B 9/10; C22C 21/02

[52] U.S. Cl. ..... 75/257; 75/148

[58] Field of Search ..... 75/68, 148, 94

[56] References Cited

U.S. PATENT DOCUMENTS

| | | | |
|---|---|---|---|
| 1,940,922 | 12/1933 | Sterner-Rainer | 75/148 |
| 3,953,202 | 4/1976 | Rasmussen | 75/68 R |

*Primary Examiner*—Peter D. Rosenberg

*Attorney, Agent, or Firm*—Oldham & Oldham Co.

[57] ABSTRACT

A grain-refining flux in the form of vitrified spheroids, ranging in diameter from about 5 to 40 mm., and consisting of, by weight, 95 - 65% of sodium hexametaphosphate and 5 - 35% of alumina. It is highly effective irrespective of the Si content of the aluminum alloy material as well as of the casting thickness. It is quite easy to handle in practical application, not producing any harmful gases, and can be safely stored owing to its lack of hygroscopicity.

6 Claims, 7 Drawing Figures

Primary Si Crystal Grain Size, μm
60
50
40
30
20
10
0
No Fluxing
Fluxing of the Invention
9
8
7
6
5
4
3
2
1
0
Thickest
Cast Section Thickness, mm
Wedge Point

FLUX FOR REFINEMENT OF PRO-EUTECTIC SILICON CRYSTAL GRAINS IN HIGH-SILICON ALUMINUM ALLOYS

BACKGROUND OF THE INVENTION

This invention relates to fluxes of the kind used for refinement of primary or pro-eutectic Silicon crystal grains in high-silicon aluminum alloys.

In recent years, hyper-eutectic Al-Si alloys have come to be used extensively not only as materials for engine pistons but also as those for other automotive parts including crankcases, cylinder liners and brake drums because of their excellent characteristics. Lo-called hyper-eutectic Al-Si alloys contain about 12% or over of silicon and, among others, aluminum alloy materials for casting or forging use containing from about 17% to about 25% of silicon are called high-silicon aluminum alloys and are known to exhibit highly excellent properties including: (1) a coefficient of thermal expansion lower than that of any other aluminum alloy material; (2) a Satisfactory wear resistance; and (3) a considerable resistance to heat. The practical range of use of high-silicon aluminum alloys, however, has been rather limited as, upon solidification, primary crystals of silicon grow into coarse square-shaped grains, impairing the mechanical properties, including machinability, of the resulting alloy product.

The relationships of the silicon content of Al-Si bivary alloys to their coefficient of thermal expansion and to some of their mechanical properties are graphically illustrated in FIG. 1. As observed, the thermal coefficient of Al-Si alloys linearly decreases with increase in silicon content. Obviously, the lower the thermal coefficient of the engine material is, the smaller is the amount of thermal expension of engine parts made of such material as occuring with rise in temperature of the engine in operation and the more the clearence between the piston and associated cylinder wall can be reduced to improve the engine performance. This is the reason why hyper-eutectic Al-Si alloys have come to be widely employed as materials for pistons and other engine parts. However, parts made of hypereutectic Al-Si alloys and, among others, of so-called high-silicon aluminum alloys have previously been limited in finishing accuracy because of the formation therein of coarse primary crystal grains of silicon and, under this situation, the technique for refinement of primary crystal grains in high-silicon aluminum alloys is growing particularly important.

Conventional methods of refining primary crystal grains of silicon, which principally include an addition of phosphorus, are listed below:

1. Addition of phosphorus penta-chloride ($PCl_5$);
2. Addition of Cu-P alloys or Fe-P or Ni-P alloys;
3. Addition of elementary phosphorus or its mixture with KCL or $K_2T_iF_6$;
4. Addition of an element or elements other than phosphorus (for example, $Z_nS$, $F_eS_2$, $T_i = Z_n$, V, $G_a = S_e$); and
5. Solidification by quenching or ultrasonic vibration.

The first method, (1), is rather limited in industrial use for a number of reasons including: unpleasing smell rising during the addition of $PCl_5$ to the molten mass, remarkable hygroscopicity of $PCl_5$ and hence handling inconvenience in its use. The method (2) is disadvantageous in that elementary metals are admixed in substantial amounts together with P. Among others, inclusion of Fe in any amount should be avoided as it impairs the quality of resulting alloy products. The method (3) is dangerous as phosphorus, when added to the molten mass, burns violently on the top thereof and disadvantageous in that any stable application of the additive is hardly feasible. As regards the method (4), any of the additive elements used therein seems to be less effective than phosphorus in view of the results of many investigations previously made and reported. Finally, the method (5) is considerably effective but lacks practicability with its range of application limited because of the volume of meet and the equipment required.

Under these circumstances, use of fluxes is considered desirable in order to attain the purpose of refining primary silicon crystal grains at all times in a stable condition. Fluxes previously employed, however, have contained as a main ingredinet a phosphorus compound with chlorine or fluorine and, when applied, unavoidably produced gases harmful to the operator and other neighboring persons. The only measure previously resorted to meet this situation has been just to manage to reduce the amount of evolving gases as far as possible.

SUMMARY OF THE INVENTION

The present invention is intended basically to solve the problems previously encountered in the art as described above and has for its object the provision of a novel form of flux usable for refinement of pro-eutectic or primary silicon crystal grains in high-silicon aluminum alloys which is effective at least equally to conventional chloride or fluorine-base fluxes, containing phosphorus pentachloride ($PCl_5$) as a main ingredient, and which does not produce any gases harmful to the operator. It is an important feature of the present invention that the flux is made in form of glassy or vitrified spheroids of appropriate size and, exhibiting no hygroscopicity, is particularly easy and safe to handle.

The ideal flux for use in the melting of aluminum alloys is required to satisfy the conditions listed below:

1. It is capable of adsorbing or dissolving aluminum oxide, silicate and other impurities in the melt;
2. It has a relatively low reaction temperature;
3. It has a specific gravity smaller than that of aluminum;
4. It is economically inexpensive;
5. It is nonliquid in form;
6. It can be stored without causing any reduction in efficacy;
7. There is no formation of harmful contaminants upon reaction of the flux with the alloy melt;
8. The flux per se is harmless;
9. It does not vaporize in any violent manner at the melting temperature; and
10. The slag formed with use of the flux is readily separable from the cast base metal.

The flux of the present invention is practically ideal, satisfying all of the conditions listed, as will be apparent from the following description when taken in conjunction with the accompanying drawings, which illustrate characteristic features of the flux embodying the present invention.

DESCRIPTION OF THE PREFERRED EMBODIMENTS

Description will first be made of the procedure of preparing the flux of the invention.

Figure 1:
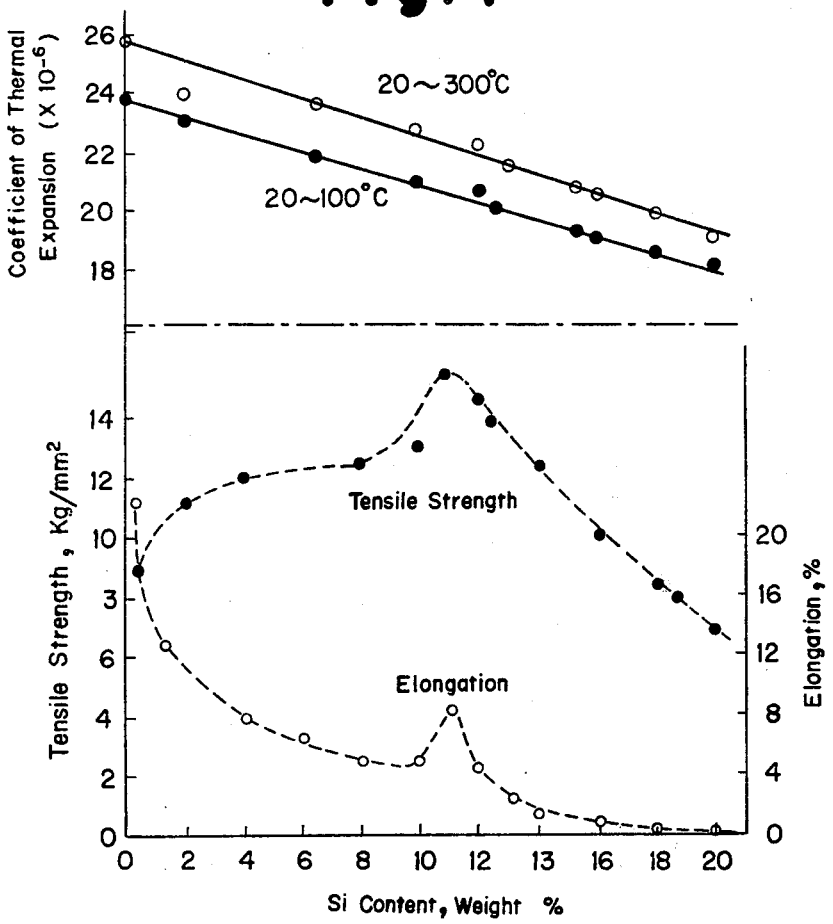
FIG. 1 is a graphic diagram showing, for reference, the relationship of the silicon content of Al-Si binary alloys to their coefficient of thermal expansion and also to their tensile strength and elongation.
Figure 2:
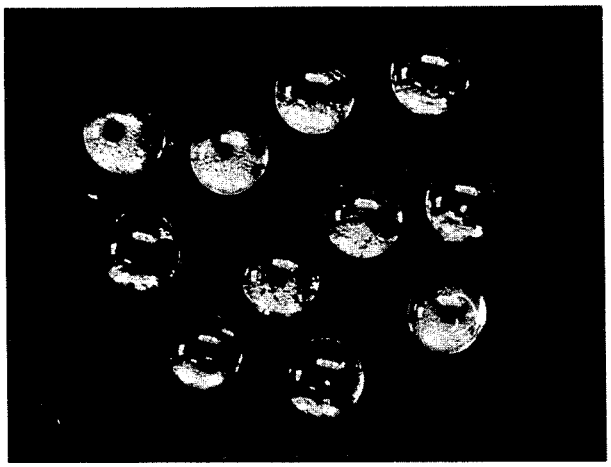
FIG. 2 is a photograph showing, on an enlarged scale, the external appearance of the flux embodying the present invention.

A mixture of 95 - 65% sodium hexametaphosphate $(NaPO_3)_6$ and 5 - 35% alumina $(Al_2O_3)$ is made and melted at the temperature of approximately 1000° C or above. The molten mass is held in the state at a definite temperature for an appropriate period of time to allow air bubbles trapped in the melt to be released therefrom. Subsequently, the temperature of the melt is lowered until its viscosity is reduced to an appropriate level. Then, the melt is dropped onto a metal plate to obtain a desired form of flux thereon. As seen in the photograph of FIG. 2, the flux obtained on the metal plate takes the form of glassy or vitrified transparent spheroids. Sodium hexametaphosphate is a compound which is highly hygro-scopic in nature but it has been found that, in the procedure described above, which includes the steps of melting the mixture of the phosphate with alumina at an appropriate temperature and then cooling the melt to solidify into glassy spheroids of approximate size, the phosphate is converted into a state exhibiting no hygroscopicity at all. Owing to this, the flux of the invention can be conveniently stored; and, due to its size and shape, can be handled with extreme ease. According to the results of experiments conducted by the inventor, the flux should be formed in diameters ranging from about 5 mm. to about 40 mm. for best results.

Figure 3:
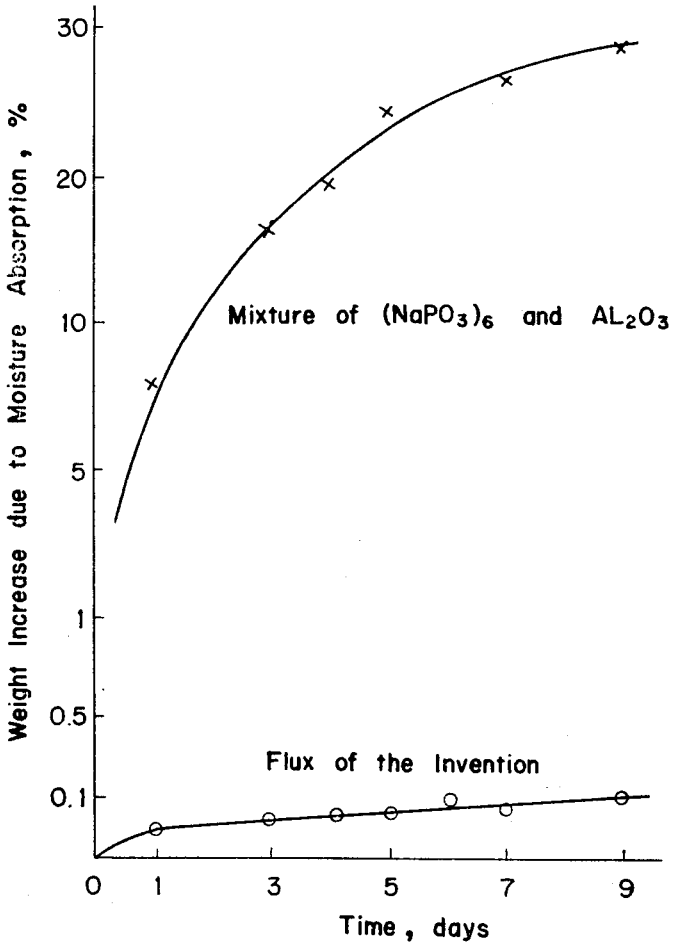
FIG. 3 is a graphic diagram showing the results of tests conducted on the flux of the invention and the raw mixture therefor to compare the percentage increase in weight resulting from moisture absorption.

FIG. 3 graphically illustrates the results of comparison tests made on the flux of the invention and the raw mixture therefor to compare the moisture absorption and resulting percentage change in weight of the samples when left to stand for 9 days in the room atmosphere of, on the average, 60% humidity. The raw mixture of sodium hexametaphosphate and alumina rapidly solidified, absorbing moisture in the air, and exhibited a weight increase of approximately 8% in the first day and of as much as 26% in one week. In contrast, the moisture absorption of the flux of the invention in the form of glassy spheroids was less than 0.1% even after it had been left to stand for one week, indicating that, when stored, the flux remains substantially unchanged in its initial state.

Further, most of conventional fluxes are of powdery form, enabling only an inefficcient fluxing operation, and, in their application, a substantial loss of flux is unavoidable. Such difficulties can be overcome by use of the flux of the invention which takes the form of glassy spheroids. It will also be appreciated that the flux of the present invention is highly suitable for use with hyper-eutectic Al-Si alloys because of its melting temperature ranging between about 650° C, and about 750° C., which is considerably low compared with the melting point of such alloys, which ranges from about 750° C. to about 850° C.

Further, the flux of the present invention exceeds in economics as it can fully serve the intended purpose of refining primary crystal grains in hyper-eutectic Al-Si alloys if only it is employed in such a limited amount as of from about 1% to about 2% of the weight of the alloy melt. Also, the fluxing procedure with the flux of the invention is extremely simple and includes the only step of scattering the flux over the surface of the molten alloy mass, not necessitating any agitation of the system. This forms another advantageous feature of the present invention, enabling a highly efficient fluxing operation.

The flux scattered on the surface of the molten mass, which is held at a temperature of from about 750° C. to about 850° C., is immediately melted into a vitrified state and covers the melt surface to keep it out of contact with the atmosphere. In this manner, the melt is effectively prevented from absorbing any amounts of external gases and its loss as caused by oxidation is minimized. With the case of any conventional form of flux, the alloy melt added therewith must be fully agitated in order to promote the reaction of the flux therewith but the flux of the invention can work to a full extent in as short a reaction time as from about ten to fifteen minutes without need for any agitation as it exhibits its grain-refining effect by interfacial or boundary reaction with the melt.

Further, since the reaction at the melt surface is very quiet, not requiring any agitation, there is no danger of formation of oxides or ingress of external gases as occurring with agitation of the melt system and there is no generation of fume or harmful gases during the fluxing operation. This obviously makes use of the flux of the present invention highly advantageous from the standpoint of operational safety.

Figure 4:
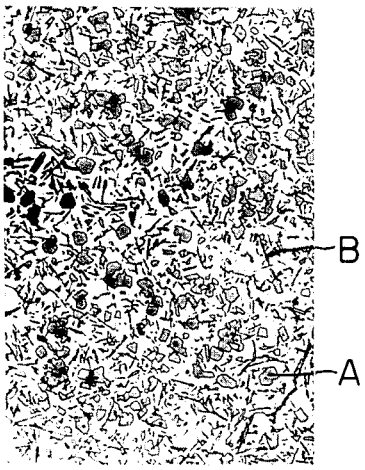
FIG. 4 is a photomicrograph of a 20% - Si aluminum alloy casting including primary Si crystal grains refined with the flux of the invention added.
Figure 5:
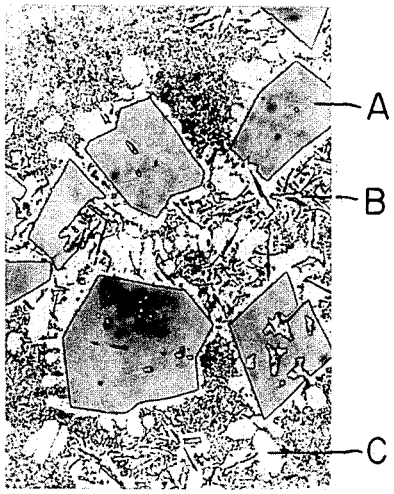
FIG. 5 is a photomicrograph of a casting formed of the same alloy material with no flux added.

Reference is now made to FIGS. 4 and 5, which represent the results of experiments performed with a hypereutectic Al-Si alloy containing 20% Si to demonstrate the grain-refining effect of the flux of the invention. FIG. 4 is a microphotograph illustrating appearance of primary Si crystal grains as refined by addition of the flux of the invention, FIG. 5 illustrating appearance of coarse primary crystal grains as formed without use of the flux. In the two figures, reference character A indicates primary crystals of silicon; B indicates the eutectic matrix ($\alpha$+ Si); and C indicates $\alpha$ crystals.

As clearly shown by comparison of FIG. 4 with FIG. 5, the flux of the present invention is highly effective to refine primary silicon crystal grains and, giving quite a uniform distribution of eutectic matrix, makes it possible to obtain castings highly improved in structure.

Generally, high-silicon aluminum alloys among those alloys which, upon solidification, form coarse primary crystal grains and show a remarkable tendency toward segregation of proeutectic silicon. Particularly, in castings having different sections, the segregation of proeutectic silicon is conspicuous and heavily impairs the quality of such castings. In other words, high-silicon aluminum alloys are alloys highly susceptible to the section thickness or mass effect. The thickness susceptibility of this kind of alloys, however, can now be materially reduced by application of the flux of the invention.

Figure 6:
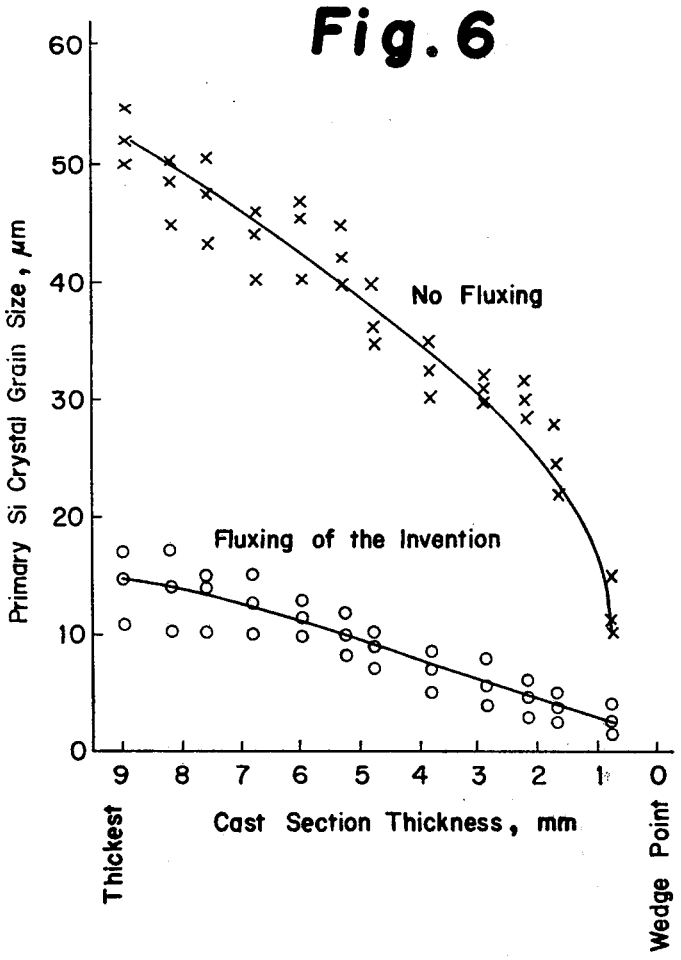
FIG. 6 is a graphical representation of the results of comparison tests conducted on 20% - Si aluminum alloy castings, obtained with and without use of the flux of the invention, illustrating the relationship between the section thickness and the size of primary silicon crystal grains.

FIG. 6 is a graphical representation of the results of tests conducted with 20% - Si aluminum alloy to compare the size distribution of primary silicon crystal grains in its castings formed in a wedge-shaped mold with and without use of the flux of the invention. As observed, in the tapered, castings formed without addition of the flux, the size of primary silicon crystal grains ranged from about 50 μm at the thickest end of the casting to about 10 μm at its tip end. In contrast, in the castings formed with an addition of the flux of the invention, the grain size ranged only between about 15 μm and 3 μm, indicating that use of the flux materially reduces the thickness susceptibility of the high-silicon aluminum alloy, enabling production of highly homogeneous castings thereof. The fluxing conditions employed in the comparison tests were as follows:

| | |
|---|---|
| Fluxing temperature | 850° C. |
| Fluxing time | 10 min. |
| Amount of flux used | 2.0% |
| Mold temperature | 200° C. |

Figure 7:
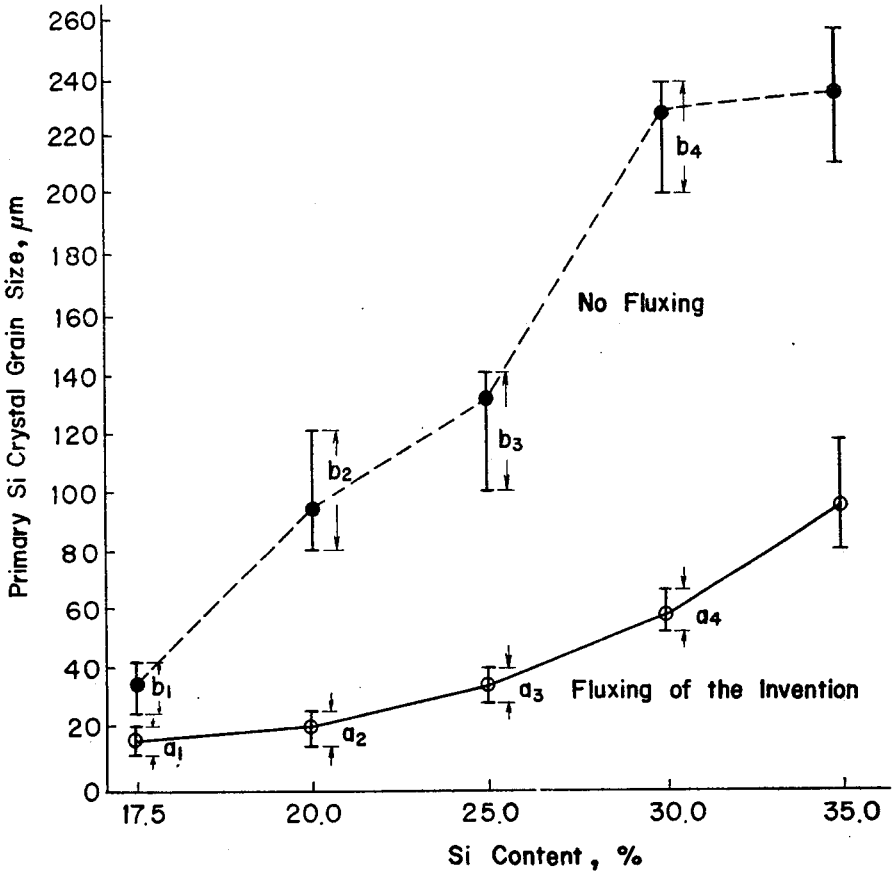
FIG. 7 is a graphic diagram showing the relationship between the Si content of Al-Si alloys and the size of primary silicon crystal grains forming in castings made with and without use of the flux of the invention.

As is well known, the grain size of pro-eutectic silicon in hyper-eutectic Al-Si alloy castings generally increases with the Si content of the casting material and this also is clearly seen in the graphic diagram of FIG. 7, which represents the results of further tests conducted with hyper-eutectic Al-Si alloys to determine the grain-refining effect of the flux of the invention. In this diagram, the lower, solid line indicates the grain sizes in castings of different Si contents formed with the flux of the invention applied while the upper, broken line indicates those in castings formed without use of the flux.

Again in the diagram of FIG. 7, reference characters $a_1$ $a_2$, $a_3$ and $a_4$ indicate respective ranges of primary crystal grain size, in μm, determined of castings made of materials respectively containing 17.5%, 20%, 25%, 30% and 35% Si and all fluxed according to the invention; and $b_1$, $b_2$, $b_3$ and $b_4$ indicate those obtained without such fluxing. As will be readily observed, variations in grain size of pro-eutectic silicon occurring in castings made with the flux of the invention added are much smaller than those in castings made without use of the flux.

It will be appreciated from the foregoing description that primary crystal grains, of silicon, in hyper-eutectic Al-Si alloys can be effectively reduced in size by use of the flux of the invention, irrespective of the Si content of the alloy material. Only, it is to be admitted that there is a tendency that the size of primary silicon crystal grains as refined by use of the flux of the invention increases with the Si content of the alloy material.

It will also be appreciated from the test results described above that the flux of the invention can be applied with satisfactory results even to aluminum alloys with such a high silicon content as about 25 - 30%, which is regarded in the art as the upper limit of silicon content allowable with Al-Si alloys for casting use.

While one complete embodiment of the invention has been disclosed herein, it will be appreciated that modification of this particular embodiment of the invention may be resorted to without departing from the scope of the invention.

What is claimed is:

1. A grain-refining flux for high-silicon aluminum alloys, characterized in that it is made of a fused mixture consisting of, by weight, from about 95% to about 65% of sodium hexametaphosphate, $(NaPO_3)_6$, and from about 5% to about 35% of alumina, $(Al_2O_3)$.

2. A grain-refining flux as in claim 1, where the flux comprises vitrified particles that are spheroidal in form and range in diameter from about 5 millimeters to about 40 millimeters.

3. A flux as in claim 1 where said flux is non-hygroscopic.

4. A method of making a flux as defined in claim 1 and including mixing the sodium hexametaphosphate and alumina, melting the mixture at a temperature of at least approximately 1,000° C., and cooling the melt to solidify it.

5. A method of making a flux as in claim 4, and including lowering the temperature of the mixture after having been heated to above 1,000° C., and dropping the melt onto a metal plate to obtain glassy spheroidal particles of flux.

6. A method of manufacturing for a grain-refining flux for high-silicon aluminum alloys according to claim 1, which comprises melting of the mixture of sodium hexametaphosphate $(NaPO_3)_6$ and alumina $(Al_2O_3)$ at approximately 1,000° C. or above, holding the molten mass in the state at a definite temperature for an appropriate period of time to allow air bubbles trapped in the melt to be released therefrom, and then dropping the melt onto a metal plate to provide forms of vitrified transparent spheroids.

* * * * *

UNITED STATES PATENT OFFICE

CERTIFICATE OF CORRECTION

PATENT NO. : 4,053,304

DATED : October 11, 1977

INVENTOR(S) : Masatoshi Tsuda

It is certified that error appears in the above-identified patent and that said Letters Patent are hereby corrected as shown below:

Column 1, line 59, change "$Z_nS$, $F_eS_2$, $T_i = Z_rV$, $G_a$ =" to

-- $Z_nS$, $F_eS_2$, $T_i + Z_rV$, $G_a$ + --

Column 4, line 63, after "alloys", insert -- are --

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*